United States Patent [19]

Zuber

[11] 4,325,214

[45] Apr. 20, 1982

[54] APPARATUS FOR STRANDING WIRE

[75] Inventor: Bretislav P. Zuber, Montreal, Canada

[73] Assignee: Northern Telecom Limited, Montreal, Canada

[21] Appl. No.: 206,656

[22] Filed: Nov. 13, 1980

Related U.S. Application Data

[63] Continuation-in-part of Ser. No. 106,375, Dec. 21, 1979, abandoned.

[30] Foreign Application Priority Data

Dec. 19, 1979 [CA] Canada ..... 342240

[51] Int. Cl.[3] ..... H01B 13/04

[52] U.S. Cl. ..... 57/293; 57/332; 57/344

[58] Field of Search ..... 57/293, 294, 332, 3, 57/13, 344–349

[56] References Cited

U.S. PATENT DOCUMENTS

| | | | |
|---|---|---|---|
| 3,572,024 | 3/1971 | Lyons | 57/293 X |
| 3,704,580 | 12/1972 | Blanchet et al. | 57/293 |
| 3,847,190 | 11/1974 | Forester | 57/293 X |
| 3,910,022 | 10/1975 | Reed | 57/293 |
| 4,214,432 | 7/1980 | Scheidt | 57/293 |

*Primary Examiner*—John Petrakes

*Attorney, Agent, or Firm*—R. J. Austin

[57] ABSTRACT

Wire stranding apparatus for giving a periodic reverse twisting operation, in which a rotationally flexible elongate member, preferably a rod, carries wire guiding elements extending radially outwardly from it. Each element has guide holes for wires as they are passed along the rod. Stranding is done by holding an upstream end of the rod stationary and while the wires are moved along guide paths, the downstream end of the rod is rotated for a predetermined number of revolutions about its axis alternately in one direction and then the other. Wires are thus stranded in alternating directions.

13 Claims, 10 Drawing Figures

APPARATUS FOR STRANDING WIRE

This is a continuation-in-part of application Ser. No. 106,375, filed Dec. 21, 1979, and now abandoned.

This invention relates to the stranding of wires.

It is known that the twisting of wires together during their assembly together offers physical and electrical advantages when used in communication or other electrical systems. For example, twisting of pairs of wires as used in telephone systems improves electrical characteristics, such as reducing crosstalk.

Conventionally, to continually twist wires together in the same direction requires a heavy movable construction as the wire spools for feeding wire into the apparatus must also revolve about the machine axis. The heavy construction limits the operational speed. To avoid the rotation of the spools, a periodically reversing twist is given to the wires and as it is desirable to twist long lengths of wires, accumulators become necessary.

In order to overcome problems with known twisting apparatus, simplified apparatus has been devised to give a periodic reverse twisting operation. This simplified apparatus, as described in U.S. Pat. No. 3,910,022 in the name of Phillip John Reed, assignee Northern Electric Company Limited, involves the use of a tubular member one end of which is held stationary and the other twisted first in one direction and then the other. Dividers positioned along the tube form separate paths for wires passing down the tube and a twisting means at a tube outlet places the reverse twist in the wires.

The invention described in the above patent is effective in creating reverse twist. It has certain disadvantages, however, namely that because it is long, i.e. about 37 feet long (11.27 meters) with 0.5 inch (1.27 cms) inside diameter, it is difficult to thread or pass wires in their correct positions down the tube and this procedure is a tedious and time comsuming operation. If the tube is formed of transparent plastic to give visual aid to wire threading, the transparency is lost after a short period of use due to impurities deposited upon the tube surface and due to changes in the plastic itself. Also, the friction between the wires and the inside wall of the tube may be sufficiently high to result in some stretch.

According to the present invention, apparatus for stranding wires comprises an elongate member havng a longitudinal axis and being rotationally flexible about said axis; a plurality of wire guiding elements extending radially outwardly from the member and defining a plurality of longitudinally extending wire guiding holes, the holes being angularly spaced around the axis, for passage therethrough of a plurality of wires, and also being longitudinally spaced with each hole corresponding with other longitudinally spaced holes to define a single guide path for wires; wire twisting means at the downstream end of the member, the twisting means extending outwardly of the member and defining a plurality of longitudinally extending holes, one for each of the paths and angularly spaced around the axis; holding means for holding the member stationary at a position upstream of the wire guiding elements and of the downstream end; and means for rotating the downstream end of the member and the twisting means for a predetermined number of revolutions about the axis alternately in one direction and then the other.

In a preferred arrangement, each of the guiding elements is a disc through which the elongate member extends with the disc secured to the member. Each disc is formed with a plurality of angularly spaced holes, one for each guide path. Alternatively, each guide element is a plate extending outwardly from the elongate member and extending around predetermined degrees of arc. The plates would each be provided with holes for some, but not all, of the paths and plates would be angularly as well as longitudinally spaced to provide holes for all of the paths.

The elongate member may comprise a single tube, rod or wire or may comprise a plurality of tubes, rods or wires suitably joined end-to-end to transmit angular twisting motion from the downstream end along the member. Alternatively, the elongate member is of composite construction designed to give small inertial resistance to change in direction of rotational movement. Composite constructions useful in this regard are formed from plastic. One particular construction has a core of plastic rope with a braided cover jacketed by a covering layer which may be nylon. Low inertial resistance allows the apparatus to be operated at higher speeds of oscillation than is possible with apparatus described in U.S. Pat. No. 3,910,022 and with less driving power requirements.

It is preferable that the means for rotating the downstream end of the elongated member and the twisting means is drivably connected directly to the twisting means which in itself drives the elongate member. Advantageously, the twisting means is drivably secured to the elongate member by the downstream end of the member having a mechanically secure connection in the twisting means. To distribute torsional stresses along the elongate member, the twisting means is secured to an axially extending movement transmission tube which is disposed within it and extends further along the elongate member than the twisting means, the tube being securely and non-rotationally held onto the elongate member, for instance by epoxy resin poured into the tube and allowed to set.

Embodiments of the invention will now be described by way of example, with reference to the accompanying drawings, in which.

Figure 1:
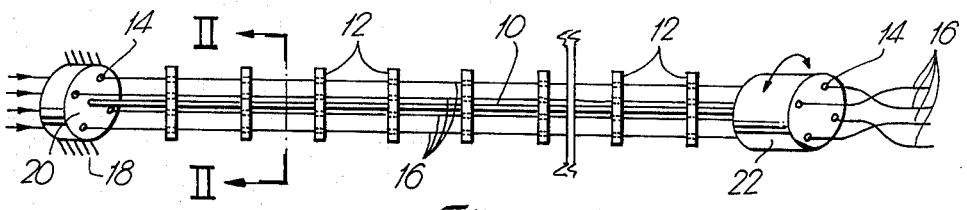
FIG. 1 is a side elevational view showing the basic concept of the invention.

As shown in FIG. 1, the invention is basically concerned with stranding wire by the use of apparatus which comprises an elongate member 10 having a longtidudinal axis and having a plurality of wire guiding elements 12 spaced apart along the member 10. The guiding elements 12 are secured to the elongate member and as shown may be discs (see also FIG. 2) with the member 10 passing through a concentric hole in each disc.

Figure 2:
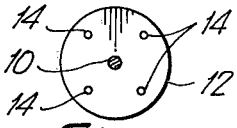
FIG. 2 is a cross-sectional view taken along line II—II in FIG. 1.

To guide wires to be stranded as they are passed longitudinally of the member 10, each guiding element 12 is formed with angularly spaced-apart wire guiding holes 14 (FIG. 2), one hole in each guiding element for each wire. In the example of FIGS. 1 and 2, four holes are provided but the number may vary and is dependent upon the number of wires to be stranded. Guide paths for the wire are provided by the holes 14 with each wire passing between elements and through corresponding holes in the elements. In FIG. 1, one wire 16 only is shown passing between elements 12 for reasons of clarity and so as not to be confused with the elongate member 10.

The elongate member 10 is rotationally flexible about its longitudinal axis. The member 10 is held stationary in a frame (shown diagrammatically at 18) at an upstream end, when considered in the sense of direction of wire movement, by a holding means which may be a wire guide block 20 secured to the frame. In end view, the block is similar to FIG. 2 in having four holes 14 corresponding to those in the guiding elements 12. An upstream end of the elongate member is secured into the guide block to prevent their relative rotation.

At the downstream end of member 10 is provided a twisting means which is conveniently a short solid cylinder 22 having holes 14 again corresponding to the number of holes in the guiding elements 12. The member 10 is non-rotatably secured to the twisting means.

In use of the invention, the wires 16 are fed along their paths through the discs and through the twisting means 22. The twisting means and downstream end of member 10 are then rotated for a predetermined number of revolutions in one direction and then the other alternately in each direction from a normal untwisted position of member 10 in which all wire paths through the holes 14 are substantialy straight. The number of revolutions on each side of the normal untwisted position may be as desired and may, for instance, be 20 revolutions. Rotation at the downstream end clearly twists the member 10 in each direction as the upstream end is fixed at 18 and the wire paths taken on helical configurations to guide the wires through the rotating twisting means 22.

The wires are fed continuously through the holes and along the member 10. The rotation of the twisting means and its directional change causes the wires to be stranded together, as they issue from the twisting means, in opposite directions of twists which alternate with one another. By holding the twisted wires by some means (not shown), after they emerge from the twisting means, any tendency for the wires to become untwisted is avoided.

Figure 3:
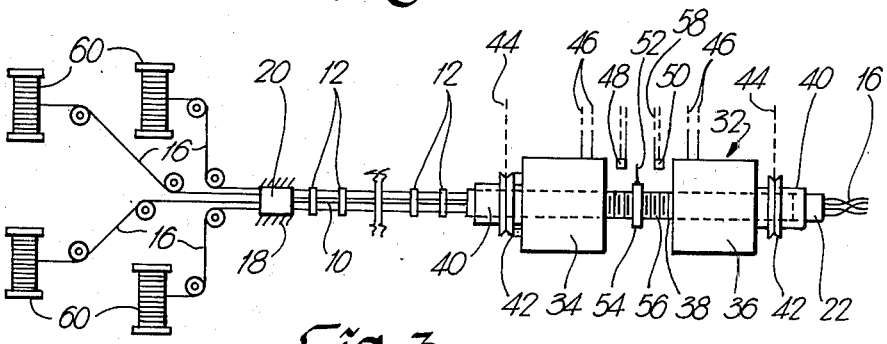
FIG. 3 is a side elevational view of apparatus forming one embodiment.

In a first embodiment shown in FIG. 3, in which parts similar to those already described bear the same reference numerals, apparatus is provided for stranding four wires 16. The four wires are shown entering the guide block 20 and emerging from the cylinder 22 but are omitted in between for clarity.

Figure 4:
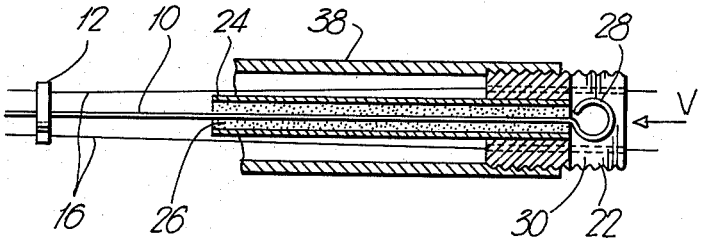
FIG. 4 is a detail of the first embodiment in longitudinal cross-section and on a larger scale.

The elongate member in this embodiment is steel rod which is high strength music wire but some alternative may be used such as steel wire. The diameter of the rod is small (around 0.06") and is capable of transmitting sufficient torque to rotate the discs 12 with it. As shown in FIG. 4, the twisting means or cylinder 22 is about 0.625" diameter and is securely attached to a concentric stainless steel transmission tube 24 of greater axial length than the cylinder. This tube has the downstream end of the elongate member 10 extended through it and secured within it by epoxy resin 26 which fills the tube and completely embeds the part of the member 10 within the tube. Because of the extra axial length of the tube 24 over member 10, torsional stresses are more evenly distributed over its downstream end than would be the case if the member 10 was directly connected to the cylinder 22.

Figure 5:
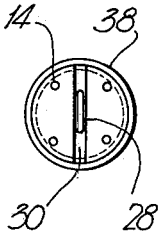
FIG. 5 is an end view in the direction of arrow "V" in FIG. 4.

The end of member 10 is also non-rotatably attached directly to the cylinder 22 by providing the end with a radially extending element in the form of a closed eye 28 which is received within a diametral slot 30 in the cylinder (see FIG. 5). The slot is filled with solder.

Means 32, shown generally in FIG. 3, is provided for rotating the downstream end of the elongate member 10 and the cylinder 22. This means comprises two clutches 34, 36 mounted in axial alignment upon a hollow shaft 38 which is secured around the upstream end of the cylinder 22 as is clearly shown in FIG. 4. Each clutch has a stub shaft 40 freely carried upon shaft 88 and a pulley wheel 42 on each stub shaft is drivable by a belt 44. The pulley wheels are driven in opposite directions by separate A.C. motors. Alternatively, the two belts 44 are replaced by a single pulley belt which passes around one pulley wheel in the opposite direction to the other pulley wheel. A single motor is then used to drive the belt which passes around conveniently positioned idler gears. The clutches are electromagnetically operated through leads 46. Each clutch has a driving option drivably connected to its pulley wheel and a driven portion connected to the shaft 38.

The clutches are actuated sequentially to drive the cylinder 22 in opposite directions. It is important that at the high speeds of operation possible with this apparatus, that the clutches are actuated precisely as required to prevent build-up of cummulative errors. An error of a fraction of a rotation in one direction if left uncorrected in the other direction could result in wire damage.

In this embodiment, the clutches are controlled by microswitches 48, 50 actuated by a finger 52 held by a nut 54. The nut is non-rotatably and axially slidably held in the frame in a manner not shown and is axially moveable along a screw thread 56 provided upon the shaft 38 between the clutches. Upon the finger 52 reaching a microswitch during rotation of the shaft 38 and cylinder 22 in one direction, the switch is actuated to de-energize one clutch and energize the other so that rotation is immediately reversed. With this arrangmeent, an accumulation of errors cannot occur. Leads 58 connect from the microswitches to a switch box (not shown) to which leads 46 of the clutches also connect.

In use, the wires 16 are fed from spools 60 through the block 20, guiding elements 12 and cylinder 22. Because of the exterior positioning of the holes 14, it is a simple matter to thread the wires through the holes and involves a small amount of time. This is especially important when a wire breakage occurs during manufacture. As the wires are visible during the whole of their passage, they are easily checked to see whether they are threaded correctly and their colour sequence around the elongate member is easily controlled.

The structure has a smaller mass than is provided by apparatus described in the aforementioned patent and smaller inertia forces are involved as less mass acts at rotational distances away from the longitudinal axis of the member 10. As a result, the rotatable structure is rotatable at much higher speeds than the structure described in the earlier patent and the power required to rotate it and reverse its rotation is thus reduced. With the apparatus of this embodiment, speeds of the order of 3800 r.p.m. should be attainable.

The twist in the wires exiting from the cylinder 22 may be retained by a physical holding means which has to operate against tension in the wires which tends to untwist them commencing at positions at which the twist alternates. Alternatively, the wires may be relieved of their tension immediately after twisting. One way of relieving tension and locking in the twist is to heat the wires rapidly as they emerge from cylinder 22. If there is any insulation on the wires, as with electrical or telecommunications wires, the insulation may be treated in various ways to prevent the wires from untwisting. For instance, a fast drying adhesive or molten plastic may be applied to the covering insulation of two wires at specific positions along the wires to hold the wires immovably together at these positions. Alternatively, the contacting insulation of adjacent wires is fused together locally at spaced positions by the application of heat or by laser treatment. Only slight fusion may be necessary and a short heating period, e.g. 10–15 milliseconds, may be sufficient to cause fusion between the insulating coatings. The heating and cooling is so quick that no damage occurs to the conductors nor any detrimental change to the insulating layers. The intermittent application of adhesive, molten plastic, heat or a laser may be controlled and synchronized with the times of reversal of the cylinder 22. As an example of the intermittent application of adhesive or molten plastic, the twisted wires are passed through the injection head of an injection machine containing the adhesive or molten plastic material. The injection machine is operated intermittently for a short period to apply the required amount of adhesive or molten plastic to the twisted wires, operation being triggered by reversal of the cylinder 22.

Another way of physically locking in the twist is to arrange for the twisted wires to be fed directly into a coating extruder. It can be arranged that the exit from the cylinder 22 is very close to the extruder inlet. Alternatively, a short length of flexible tube can be positioned between the cylinder and the inlet of the extruder. The wires are contacted by the extruding material, for example PVC, as soon as the wires enter the extruder and are then locked in their twisted state.

The wires can be relieved of the tension by passing over a capstan. The twisted wires pass a number of times round the capstan and the capstan can be overdriven slightly so that tension is applied to the wires passing through the apparatus but the wires pass from the capstan, for example to a take-up spool, under little or no tension. Alternatively a caterpillar capstan can be used.

Another alternative is to bring several groups of twisted wires together and twisting or forming into a cable. Physical contact between the wires would then prevent untwisting even if tension were applied.

The music wire of the elongate member has a useful life at least as good as, and possibly better than that provided by the tubular member of the aforementioned patent.

Figure 6:
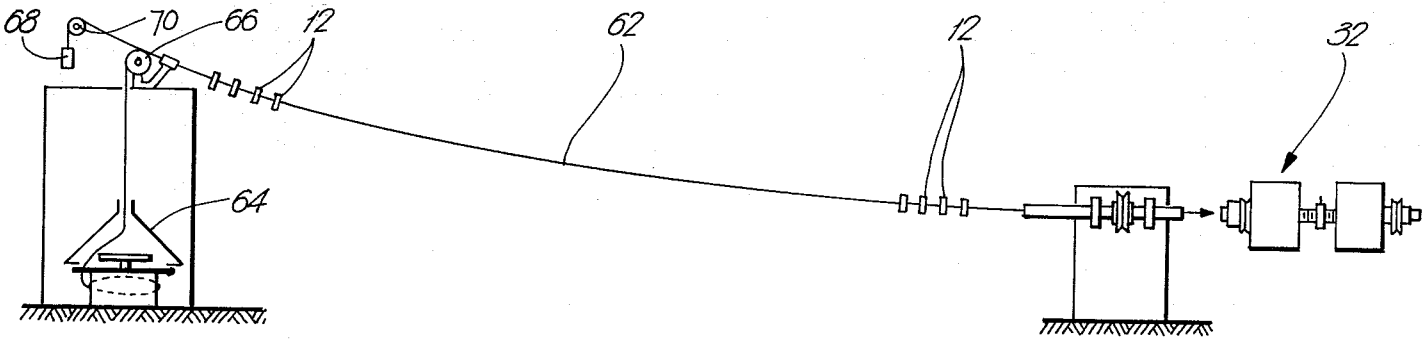
FIG. 6 is a side elevational view of apparatus forming a second embodiment.

In a second embodiment shown in FIG. 6, apparatus for stranding wire comprises an elongate member 62 having a plurality of wire guiding elements 12 as described for member 10 in the first embodiment. Means 32 is provided for rotating the downstream end of the member. Only an outline of means 32 is shown in FIG. 6 but it is of the same construction and operates in a similar manner to the means 32 described in the first embodiment. Four wires to be stranded are fed from wire give-up devices 64 (only one being shown), the wires passing over driven pulley wheels 66 to the guiding elements 12.

The apparatus of the second embodiment differs from that of the first embodiment in the holding means for holding the upstream end of the member 62 stationary. In FIG. 6 the holding means comprises a counterweight 68 attached to the upstream end of the member 62, the end portion of the member extending around at least one pulley wheel 70 to be held downwardly by the counterweight. The use of the counterweight reduces residual tension.

Figure 7:
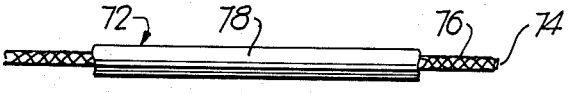
FIG. 7 is a side elevational view of part of an elongate member forming part of a third embodiment.

In a third embodiment shown by FIG. 7, apparatus for stranding wire is substantially as described for the first embodiment. It is different however in that an elongate member 72 is of composite construction and is made from plastic. The member 72 has a core 74 of rope formed from plastic monafilaments (KEVLAR or some other suitable high strength type) which is covered with a braided layer 76 of plastic wires such as Nylon. This composite is then coated with a layer of high strength plastic 78. This design is particularly light in weight and offers low inertia forces while being rotationally flexible to allow for high rotating speeds. The member 72 is held within the cylinder 22 in the manner described for member 10 in the first embodiment. The plastic material of member 62 may even be formed at its end into a radially extending element mounted within a slot of the cylinder in a manner similar to that in the first embodiment so as to assist in transmitting the driving force to the member.

Figure 8:
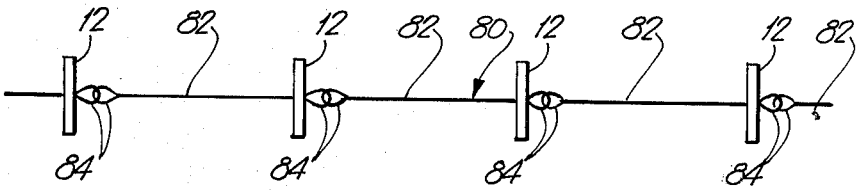
FIG. 8 is a side elevational view of an elongate member with guiding elements attached and forming a part of a fourth embodiment.

In a fourth embodiment (FIG. 8) which is also basically similar to the first embodiment, the apparatus includes an elongate member 80 made from a plurality of rods 82 joined end-to-end. Each rod is joined to an adjacent rod or rods by a means which allows for a twisting movement along the member without each rod being individually rotatably flexible. In fact each rod may be substantially rigid rotationally. The rods are joined together by interconnected eyes 84 formed at their ends. The eyes allow for a predetermined angular movement between rods. This angle may be anything desirable and could for instance be around 40° of movement. Hence, with a sufficient number the rods joined end-to-end, a large number of revolutions of the downstream end of the member and of cylinder 22 is possible while the upstream end is held stationary. It follows that where each rod carries one disc 12 as shown in FIG. 7, the end disc has a limited angular movement relative to other discs to enable the wires to follow helical paths and out through the cylinder 22. The interconnected eye couplings used in this embodiment will either eliminate or reduce residual stresses caused by oscillation.

Figure 9:
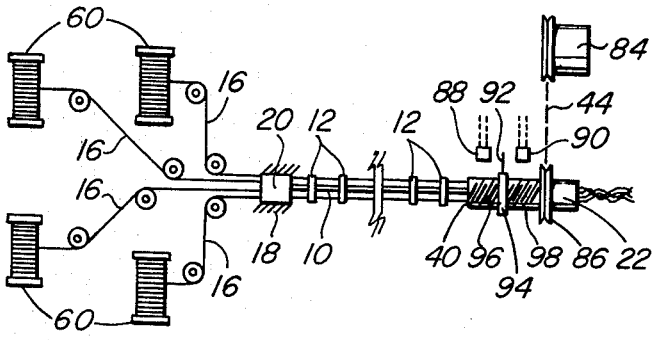
FIG. 9 is a side elevational view of apparatus forming a fifth embodiment.

In a fifth embodiment, the means 32 for rotating the downstream end of the cylinder 22 is not used. Instead of having two clutches and the separate AC motors as described in the first embodiment, a single DC electric motor 84 is used which, as shown in FIG. 9, is coupled directly to the cylinder 22 by means of a single pulley wheel 86 secured to the cylinder, and a driving belt 44. The DC motor is reversible to produce alternating directions in twist. The length of twist in each direction is controlled by reversing the motor after a certain number of twists in the other direction. This is conveniently done by the use of microswitches 88, 90 actuated by a finger 92 held by nut 94. The nut is movable along a screw thread 96 upon a shaft 98 coaxially secured to the cylinder 22. Movement of the nut to operate the microswitches is similar to the operation described in the first embodiment except that in this embodiment, the switches control the rotational direction of the DC motor.

In a modification of the fifth embodiment, means is provided to count the revolutions of the cylinder 22 automatically and to change to rotational direction of the DC motor. Thus, the use of the microswitches 88, 90 and associated equipment is avoided.

Figure 10:
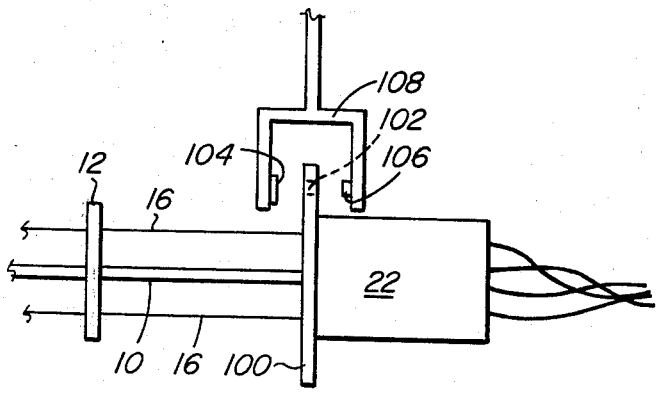
FIG. 10 is a view of part of the fifth embodiment on a larger scale and showing a modification.

As shown in FIG. 10, the counting means includes a disc 100 which may be secured at any point along the reversible rotating part of the apparatus. For convenience, as shown, it is secured coaxially at one end of the cylinder 22. The disc extends outwards beyond the cylinder and is formed with a single hole 102. The counting means also includes a light source 104 axially in line with a photoelectric cell 106 disposed at the two ends of a fixed U-shaped arm 108 which straddles the disc. The disc, as it rotates, causes the hole 102 to pass between light source 104 and cell 106 which sends signals to a control unit (not shown) which may be a microprocessor. Upon the microprocessor receiving a predetermined number of signals indicating a required number of rotations of the cylinder in one direction, it sends out a signal which causes a reversal in rotation of the DC motor.

It should be borne in mind that in the fifth embodiment, the DC motor should be one which is capable of changing direction of rotation sufficiently quickly to eliminate any slack in the wires at changeover from one lay direction to the other. The required speed of the motor is, of course, dependent upon the line speed of the wires.

Because of the use of a DC motor and clutchless drive, it is possible for the changeover from one lay direction to the other to be much quicker than with the previous emobodiments. It is believed that the number of twists in each lay direction is partly governed by the length of wire in each changeover where slackness is most likely to occur initially. Hence, if the changeover length increases, then the number of twists and the length of each lay also increases so as to absorb any slackness which may occur while preventing any noticeable untwisting effect. Thus in the fifth embodiment, because of the quick changeover from lay direction to lay direction, the changeover length is reduced below that of previous embodiments and the number of twists may subsequently be reduced in each direction. It should be realized that the length of elongate member 10 is governed by the number of twists in each direction of the wires, i.e. the length increases with twist increase, so as to restrict the angular twist on the member.

What is claimed is:

1. Apparatus for stranding wire comprising:

an elongate member having a longitudinal axis and being rotationally flexible about said axis;

a plurality of longitudinally spaced-apart wire guiding elements extending radially outwardly from the member and defining a plurality of longitudinally extending wire guiding holes, the holes being angularly spaced around the axis for passage therethrough of a plurality of wires and also being longitudinally spaced with each hole corresponding with other longitudinally spaced holes to define a single guide path for wire along the member;

wire twisting means at a downstream end of the member, in the sense of the direction of wire movement, the twisting means extending outwardly of and secured to the member and defining a plurality of longitudinally extending holes, one for each of the paths and angularly spaced around the axis;

holding means for holding the member stationary at a position upstream of the wire guiding elements and of the downstream end; and means for rotating the downstream end of the member and the twisting means for a predetermined number of revolutions about the axis alternately in one direction and then the other.

2. Apparatus according to claim 1 wherein each of the guiding elements is a disc through which the elongate member extends with each disc formed with a plurality of angularly spaced holes, one for each guide path.

3. Apparatus according to claim 1 wherein the elongate member is a single rod or wire having the guiding elements secured to it.

4. Apparatus according to claim 1 wherein the elongate member comprises a plurality of rods joined end-to-end to transmit twisting motion from the downstream end along the member.

5. Apparatus according to claim 4 wherein adjacent rods are formed at their adjacent ends with interconnected eyes which transmit the rotational motion from one rod to another while permitting relative rotational movement between rods.

6. Apparatus according to claim 5 wherein each rod is capable of rotational movement through a limited angle relative to an adjacent rod because one eye is freely movable relative to its interconnected eye, whereby a guiding element on one rod is rotatable through said limited angle relative to a guiding element on the other rod.

7. Apparatus according to claim 1 wherein the elongate member comprises a core of plastic or steel rope with a braided cover in a jacket comprising a covering layer of plastic.

8. Apparatus according to claim 1 wherein the means for rotating the downstream end of the member and the twisting means is drivably connected to the twisting means and the downstream end of the elongate member is non-rotationally secured to the twisting means.

9. Apparatus according to claim 8 wherein the twisting means surrounds a transmission tube which is secured to the twisting means, the transmission tube extending axially further along the elongate member than the twisting means and being securely and non-rotationally held around the elongate member.

10. Apparatus according to claim 9 wherein the transmission tube is held around the elongate member by epoxy resin inside the tube and within which the part of the elongate member is embedded.

11. Apparatus according to claim 9 wherein the downstream end of the elongate member is in the form of a radially extending element which is non-rotatably held within a diametral slot in the twisting means.

12. Apparatus according to claim 1 wherein the holding means comprises a block to which the upstream end of the elongate member is secured, the block being secured to a frame.

13. Apparatus according to claim 1 wherein an upstream end of the elongate member extends around a pulley wheel and hangs downwardly to the upstream end, and the holding means comprises a weight secured to the upstream end of the member.

* * * * *